United States Patent [19]

Van Vliet et al.

[11] Patent Number: 4,922,835

[45] Date of Patent: May 8, 1990

[54] MULTI-PART TABLE

[75] Inventors: Michael Van Vliet, Drummoyne; Brian Chester, Darlinghurst, both of Australia

[73] Assignee: Trychest Pty., Limited, Australia

[21] Appl. No.: 329,542

[22] Filed: Mar. 28, 1989

[51] Int. Cl.[5] ..... A47B 3/00

[52] U.S. Cl. ..... 108/114; 108/64; 108/66

[58] Field of Search ..... 108/64, 65, 66, 89, 108/114, 155, 156

[56] References Cited

U.S. PATENT DOCUMENTS

| | | | |
|---|---|---|---|
| 353,049 | 11/1886 | Barnhart | 108/64 |
| 1,649,388 | 11/1927 | Cacha | 108/114 |
| 2,489,933 | 11/1949 | Schwarz, Jr. | 108/64 |
| 2,851,311 | 9/1958 | Gibbs | 108/114 X |
| 3,779,176 | 12/1973 | Piretti | 108/66 X |

FOREIGN PATENT DOCUMENTS

| | | | |
|---|---|---|---|
| 1240329 | 7/1971 | United Kingdom | 108/66 |

*Primary Examiner*—Peter A. Aschenbrenner
*Attorney, Agent, or Firm*—Ostrolenk, Faber, Gerb & Soffen

[57] ABSTRACT

A multi-part adaptable table comprising self-supporting leg members interconnected into pairs by bearing means with each leg member adapted to support a quadrant or rectangular shaped table top portion and each bearing means adapted to support a further rectangular table top portion. The various elements of the table being arranged such that they can be disassembled one from the other to enable the table to be rearranged into various configurations.

11 Claims, 8 Drawing Sheets

MULTI-PART TABLE

BACKGROUND OF THE INVENTION

This invention relates to a table, and in particular a table which can be disassembled and rearranged in various configurations.

In the past many types of tables have been proposed and manufactured which can have their configuration changed to a limited extent. Such tables often have a construction whereby the table can be extended by the insertion of a leaf in the middle of the table top. Usually, the two ends of the table are separated allowing the central leaf to be placed in position. There is, however, a need for a table which offers much more flexibility in its shape. For example, when tables are required for functions, rather than the more standard shaped tables such as oval, rectangular or circular tables, often a table which is thinner and longer is preferred. These tables can be placed against walls enabling food or drink to be easily accessed from the one side. Sometimes it is more desirable to have smaller corner tables for placing items such as drinks, food and ash trays on.

It is an added benefit if tables are collapsible. As an example, tables are often required to be transported on to site at a function or a party. If the table can be disassembled and placed in a collapsed form, then the tables can be more efficiently transported as they can be easily stacked. Being only required to carry an individual part of the table at any one time, the tables are also more easily moved and placed in position due to the lighter weight.

SUMMARY OF THE INVENTION

The present invention, therefore, seeks to provide a table which is flexible in its shape and which can be easily disassembled and reassembled. Thus the present invention provides a table which comprises at least one pair of leg members each of the leg members being self supporting and having a bearer which interconnect the leg members of the or each pair. A multi-part table top is carried by the leg members and the or each bearer, the table top having first and second portions which abut to form a continuous surface, and having the first portion removably mounted to each of the leg members and the second portion removably mounted to the or each bearer. The table top portions and the leg members and the or each bearer are formed with interfitting projections and recesses which position and locate the table top portions to the leg members and the or each bearer. These also facilitate disconnection of the various elements one from the other and rearrangement of the elements in a desired configuration.

Preferably each of the first table top portions is substantially in the shape of a quadrant and the second table top portion may be in the shape of a rectangle having at least two opposite sides the same length as the radial sides of the quadrant shaped first portion.

An additional first table portion may be provided having the shape of a rectangle with at least two opposite sides the same length as the radial sides of the quadrant shaped first portion.

A circular recess may be located at the intersecting edge of the radial sides of the quadrant shaped first portion thereby reducing the length of the radial sides. If the table is arranged in a standard format wherein two pairs of leg members of the quadrant shaped first portions interconnected by bearer are arranged side-by-side, and the table top portions are positioned on the leg members and the bearers, the reduction in the radial sides caused by the circular recess enables a slot to be formed in the center of the table. This slot can facilitate assembly and disassembly of the various members of the table.

Preferably, the leg members for the quadrant shaped first portion comprise first and second support arms intersecting along a vertical line. The first and second support arms may be hinged along this vertical line, enabling the first support arm to be positioned parallel and adjacent the second support arm in a collapsed arrangement and also enables the first support arm to be oriented at substantially 90° to the second support arm in an operational position wherein the leg member is self-supporting. A bracing member may be releasably secured between the first and second support arms when in the operational position to rigidly secure the support arms in position. Preferably, the bracing member is releasably secured to the first and second support arms by way of a dovetail tenon located at either end of the bracing member and there being a corresponding recess located on the first and second support arms.

Preferably the leg members for the rectangular shaped first portions comprise two substantially parallel support arms interconnected by two bracing members. The bracing members may be releasably secured between the support members by way of a dovetailed tenon located at either end of the bracing member and there being corresponding recesses located on the support arms. With this arrangement, the leg members for the rectangular shaped portions are also collapsible.

In a preferred arrangement, each bearer comprises two rail members and the interfitting projections and recesses which enable the two rail members to interconnect two leg members comprise dovetailed tenons located at each end of each rail member and having corresponding recesses located on the leg members. The recesses are preferably located on the leg members such that when the rail members are in position interconnecting the leg members, the rail members are substantially parallel to one another.

The table portions may be packaged in a disassembled state and be assembled on location. If smaller tables are required, each leg member could be used individually having only the quadrant portion or rectangular portion mounted to the respective leg member, as the table top. If a longer, thinner table is required two leg members interconnected by bearing means could be arranged. The table top would then consist of three portions, such that the table would have a length of three portions and a width of only one portion. If a more standard table is required then the two sets of two leg members, each set formed by interconnecting bearing means, could be positioned together forming a table top of more conventional proportions. The dimensions of this table would be equivalent to two portions in width and three portions in length. Because all the table top portions abut to form a continuous surface all the different configurations possible still appear visually pleasing to the eye, which is important in a table design. The table configurations are visually pleasing to the eye in particular when incorporating the quadrant shaped first portions as the curved surfaces resulting from using the quadrant portions gives the perimeter of each table configuration an elegant, "finished" look.

DESCRIPTION OF THE DRAWINGS

The invention will be more fully understood from the following description of a preferred embodiment of a table which can be easily disassembled and rearranged in different configurations. The description is provided with reference to the accompanying drawings in which.

DESCRIPTION OF THE PREFERRED EMBODIMENT

Figure 1:
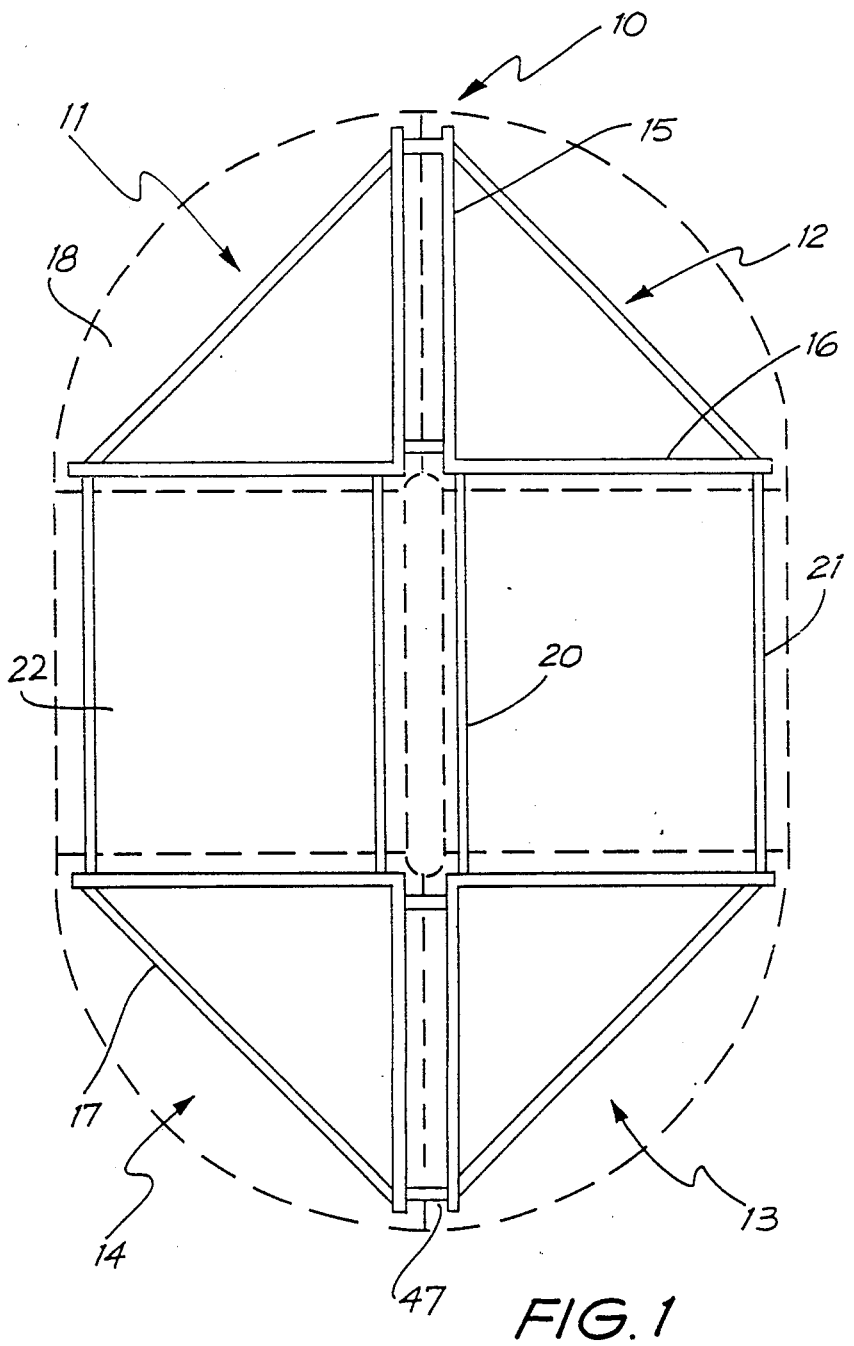
FIG. 1 is a plan view of leg members and bearing means of the table in its standard arrangement showing the table top portions in broken line.

As illustrated in FIG. 1, the table 10 which normally would be manufactured in plastic but could also be made in wood, comprises in the standard arrangement, four separate leg members 11, 12, 13 and 14, each adapted to receive a quadrant shape table top portion 18. The leg members are arranged in pairs, 11, 14 and 12, 13, with a bearer in the form of rail members 20 and 21 interconnecting the leg members of each pair. In this manner, two distinct support systems are formed, each support system having two leg members interconnected by a bearer. These two support systems are interconnected by rails 47.

Figure 2:
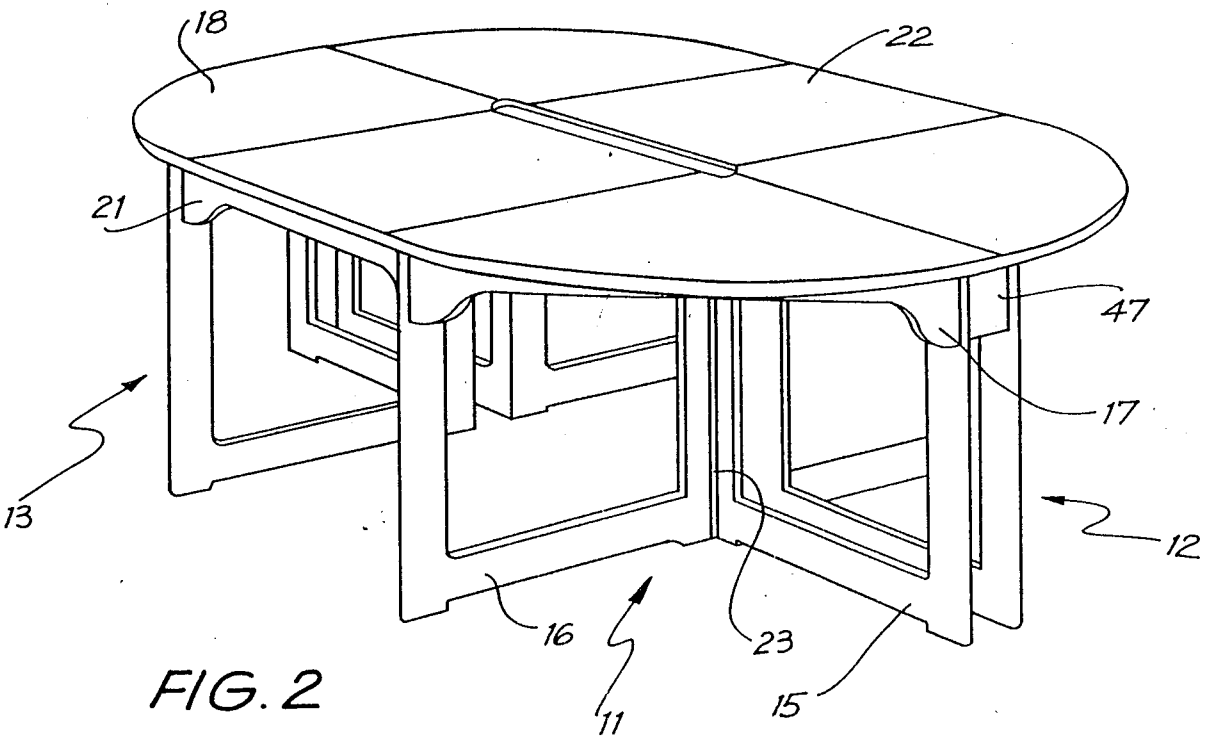
FIG. 2 is a perspective view of the table as arranged in FIG. 1.
Figures 6A, 6B, 6C:
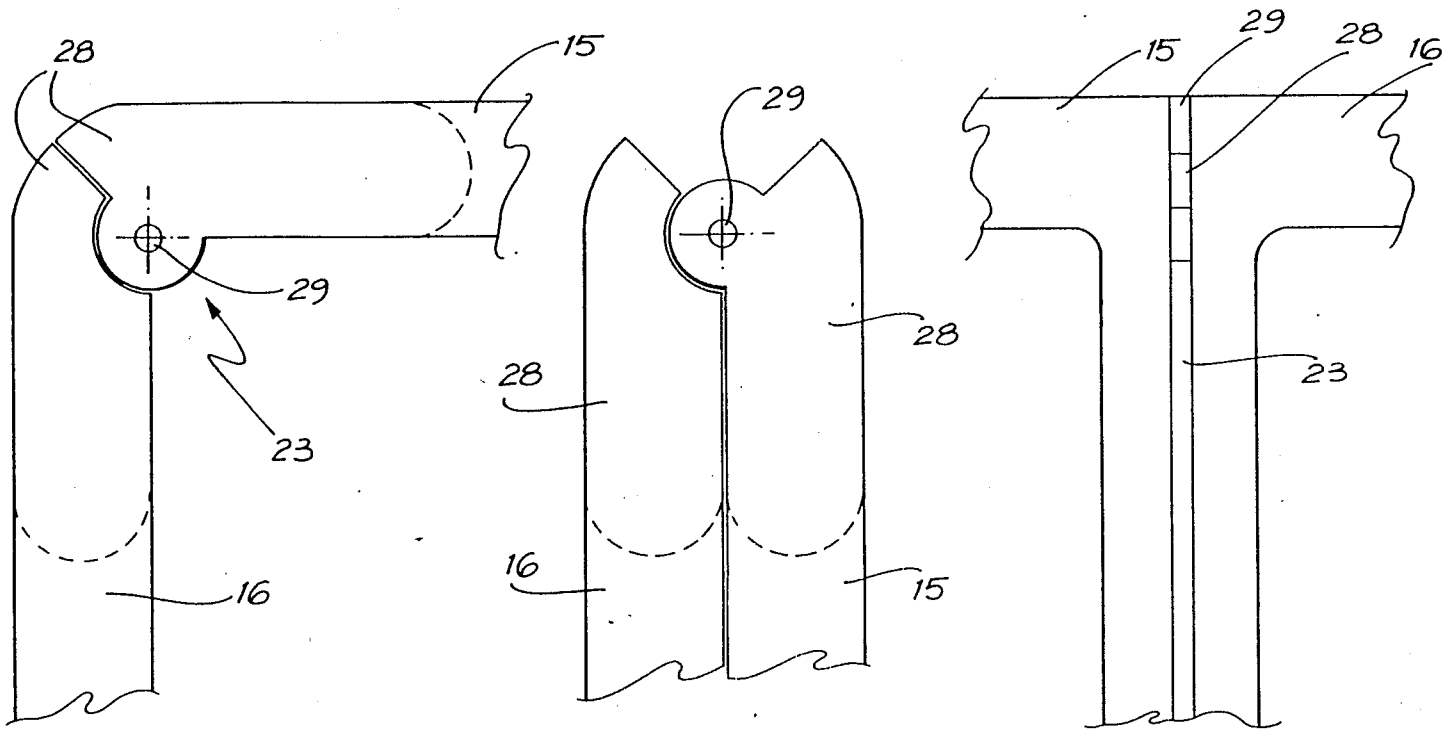
FIG. 6A is a detailed plan view of the leg member of the quadrant shaped first table top portion in an operational position.
FIG. 6B is a detailed plan view of the leg member of FIG. 6A in a collapsed position.
FIG. 6C is a detailed elevation of the leg member of 6A in an operation position.

The leg members for supporting the quadrant shaped first portions are designed such that they each can stand and support, in an operational position, at least one segment independently of any other support and can also be arranged in a collapsed position, wherein they occupy a minimum volume, enabling easy storage and transportation of the leg members. To achieve this, each leg member for supporting the quadrant shaped first portions consists of two support arms 15 and 16 hinged along a vertical joint 23 (FIG. 2). The hinged joint 23, as shown in detail in FIGS. 6A, B and C, consists of a moulded integral hinge 28 having an internal nylon pin 29. This hinge arrangement is beneficial as it enables the hinge to be fully moulded within the support means and with the addition of the nylon pin 29 reduces the posibility of relative movement between the support arms by buckling of the hinge yet enables the two support arms to be located parallel and adjacent each other in a collapsed arrangement as shown in FIG. 6B, and also enables the support arms to be oriented at 90° in an operational position as shown in FIG. 6A. When in an operational position, a bracing member 17 is positioned between the first and second support arms 15, 16 to rigidly secure the support arms in position. The bracing member 17 is connected to the support arms by way of dovetailed tenons 24 located at each end of the bracing member and there being corresponding recesses 25 located in the support arms. As shown in detail in FIG. 7, the tenon 24 of the bracing member 17 is at an angle and the recess 25 is integrally moulded within the support arm 16 thereby enabling a smooth joint between the support arm 16 and the bracing member 17.

Figure 9A:
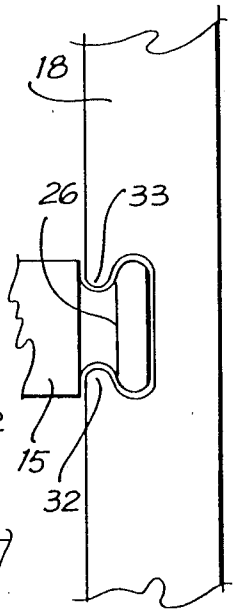
FIG. 9 is a sectional side elevation of the recess and projection along section plane A—A in FIG. 8.
FIG. 9B is a sectional side elevation of the recess and projection along section plane B—B in FIG. 8.
Figure 8:
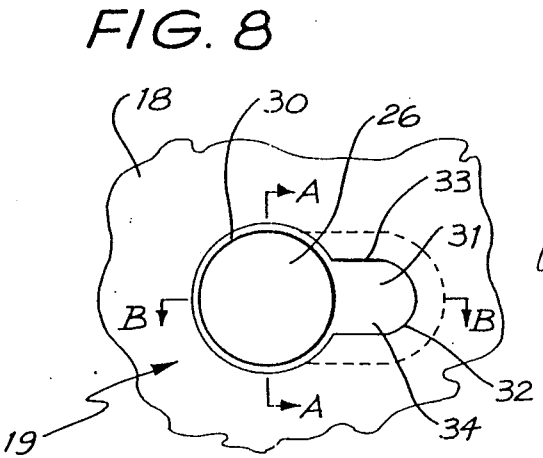
FIG. 8 is a detailed view of a recess on the top portion of the table according to the present invention containing an interfitting projection of a leg member of the table of the present invention.
Figure 9B:
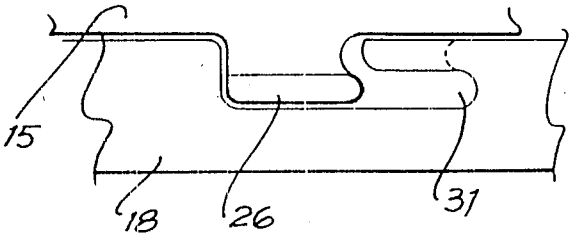

The quadrant shaped first table top portion 18 is removably mounted to each leg member. This portion is secured and correctly located onto the leg members by way of interfitting projections and recesses 19 (FIG. 8). The interfitting projections 26 are located in the top of the support arms of the leg members and the recesses are located in the underside of the quadrant portion of the table top 18. FIGS. 8, 9A and 9B show an interfitting projection recess 19 in detail. The recess is integrally set within the table top portion and consists of a keyhole slot 34. To position the table top correctly in position on the leg members, a projection 26 located on the leg member is initially inserted as shown in FIGS. 8 and 9 into the recess 19 through the wider opening 30. The table top portion is then moved to its correct location and this causes a corresponding movement of the projection 26 to the narrower opening 31 of the recess 19. In this final position (not shown), the table top portion is correctly located on the leg members and furthermore, the projection is securely located within the recess 19 by the lips of the opening 32, 33. With this arrangement, the table top portions can be easily mounted and dismounted on the leg members. The quadrant portion is oriented on each leg members such that the support arms of the leg members are parallel to the radial sides of the quadrant shaped portion.

Figure 7:
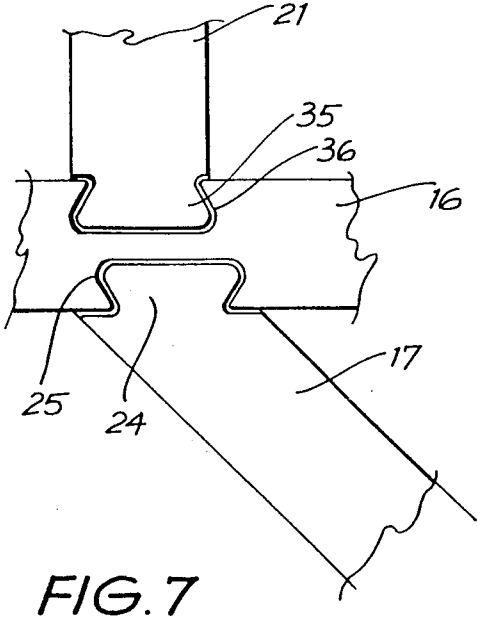
FIG. 7 is a detailed view of the connection of the bearer and bracing member to the leg member of the table according to the present invention.

Each bearer consists of two rail members 20 and 21 which are releasably secured to the support arms of the leg members by way of a dovetailed tenon 32 being located at either end of each rail member and there being a corresponding recess located on the leg members. As shown in FIG. 7, the rail member 21 is connected to the leg member in a similar arrangement as the bracing member 17 is connected to support arm 16 of the leg member. The only difference is that the tenon 35 of the rail member is not angled with respect to the rail member 16. This enables a smooth joint between the rial member and the support arm 16, when the rail member is oriented at 90° to the support arm 16. The recesses 25 are located on the leg members such that when the rail members are in position interconnecting the leg members, the rail members 20, 21 are substantially parallel to one another.

A second portion of the table top 22 is supported by these rail members and is in the shape of a rectangle having two opposite sides the same length as the radial sides of the quadrant portion of the table top.

The rail members are secured to the leg members such that the top of the rail members are at the same height as the top of the leg members, and the second table top portion 22 is located on the rail members such that it is positioned at the correct height and alignment to abut to the other portions of the tables, to allow a smooth table surface and smooth peripheral edge.

The method of securing the second portions 22 to the rail member 20, 21 is the same as the method of securing the quadrant portions to the leg members wherein interfitting projections are located on the top edge of the rail members 20, 21 and therebeing corresponding recesses located on the second table top portions 22. The projections and recesses are of the same type as those shown in FIGS. 8, 9A and 9B. This arrangement allows the rectangular portion to be easily mounted and dismounted.

As seen in FIG. 1, the length of the radial sides of the quadrant portion is slightly reduced because the quadrant portion has a circular recess on its inner periphery. As the rectangular portion is the same length as the straight side of the quadrant portion, a small slot is formed in the middle of the table. This enables the table to be more easily assembled and dismantled.

Figure 3:
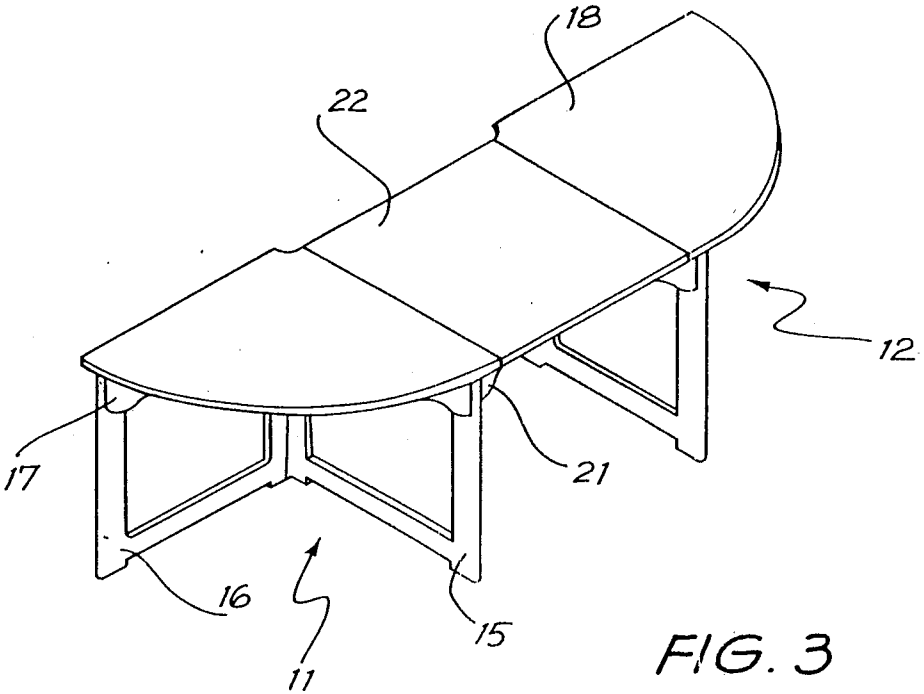
FIGS. 3 to 5 are perspective views of the table in various arrangements, each Figure showing a different configuration of the table.
Figure 4:
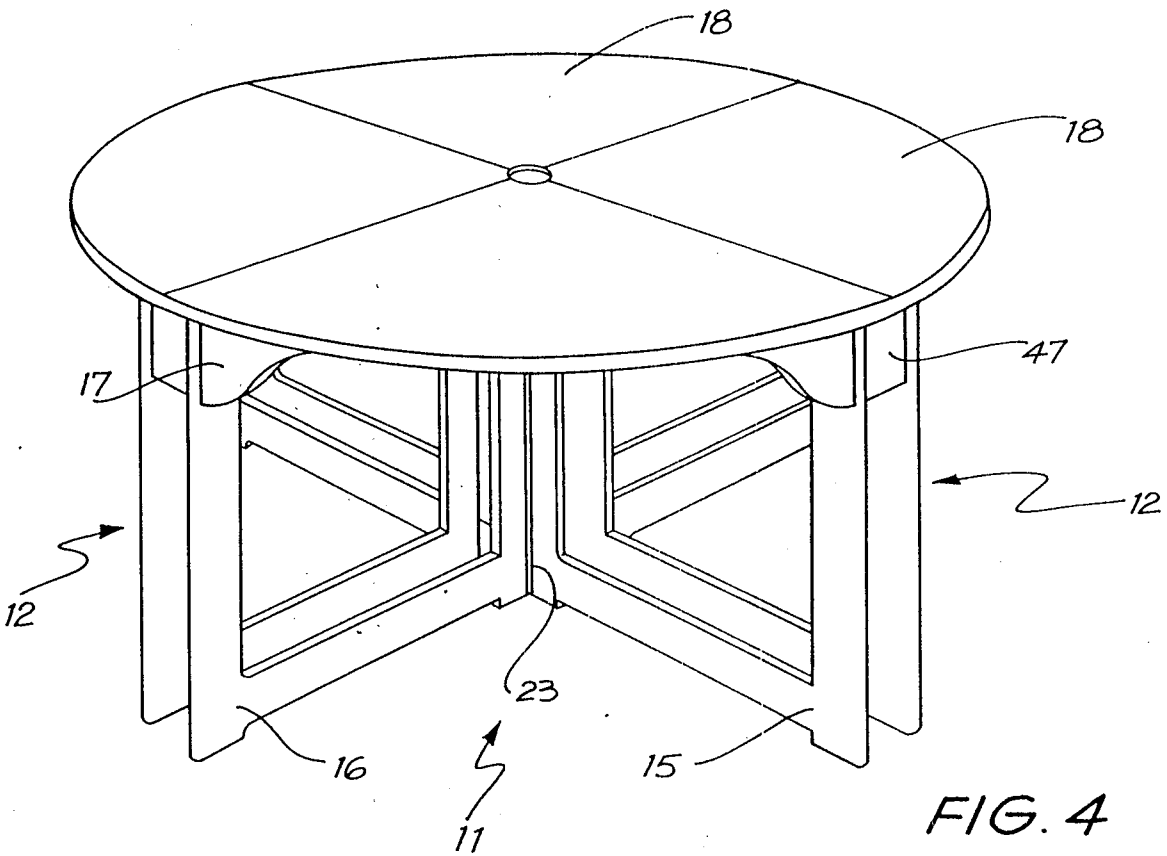
Figure 5:
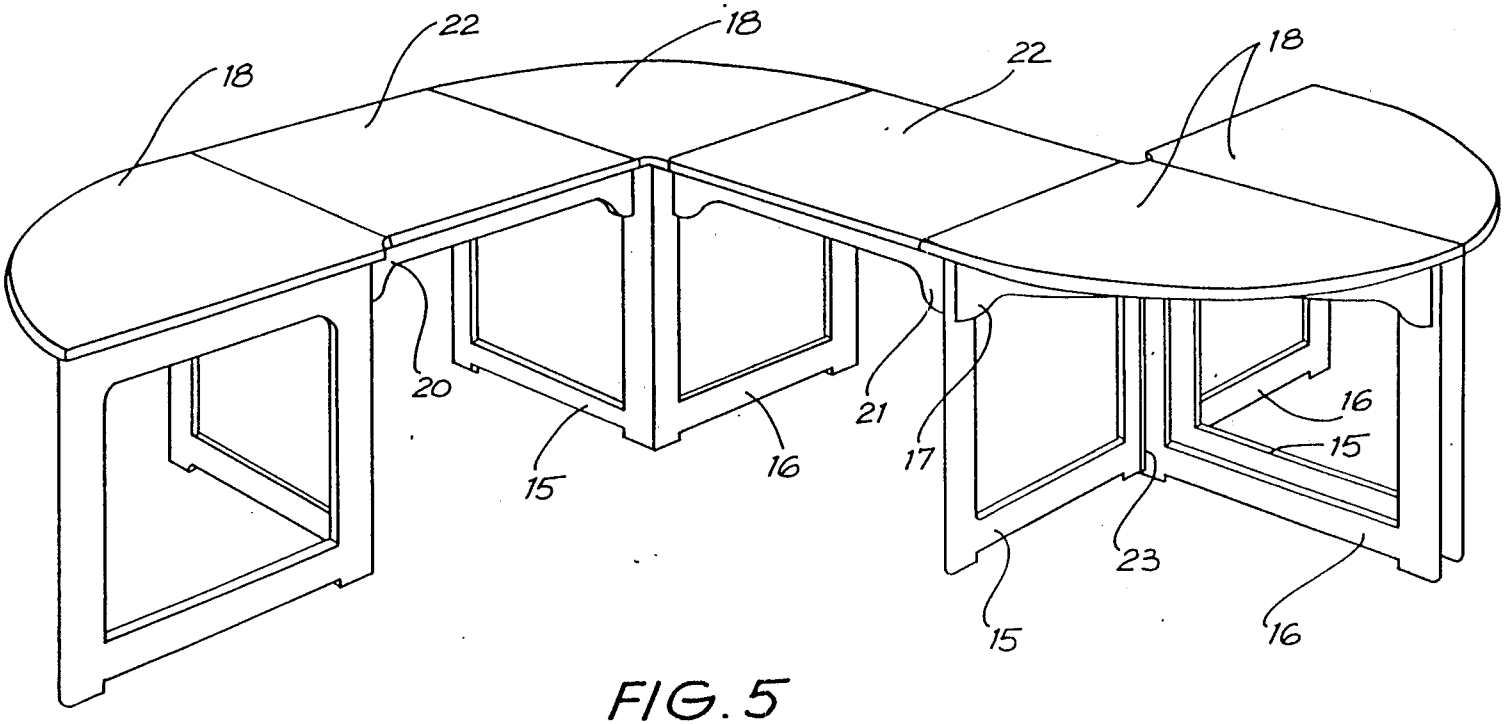

FIGS. 3 to 5 are examples of some of the possible arrangements of the different parts of the table. As can be seen in these figures, the flexibility of this table system enables circular, oval, elongated and even S-shaped tables to be formed as the table top support system enables the leg members to stand independently of one another or to be interconnected into pairs by the rail members and even enables two pairs of leg members to be interconnected by way of a common leg member to both pairs. Furthermore, as the table top portions are designed to abut one another in a continuous surface, all these different table arrangements have an aesthetic appeal as they all have smooth top surfaces and smooth peripheral edges.

Figure 10:
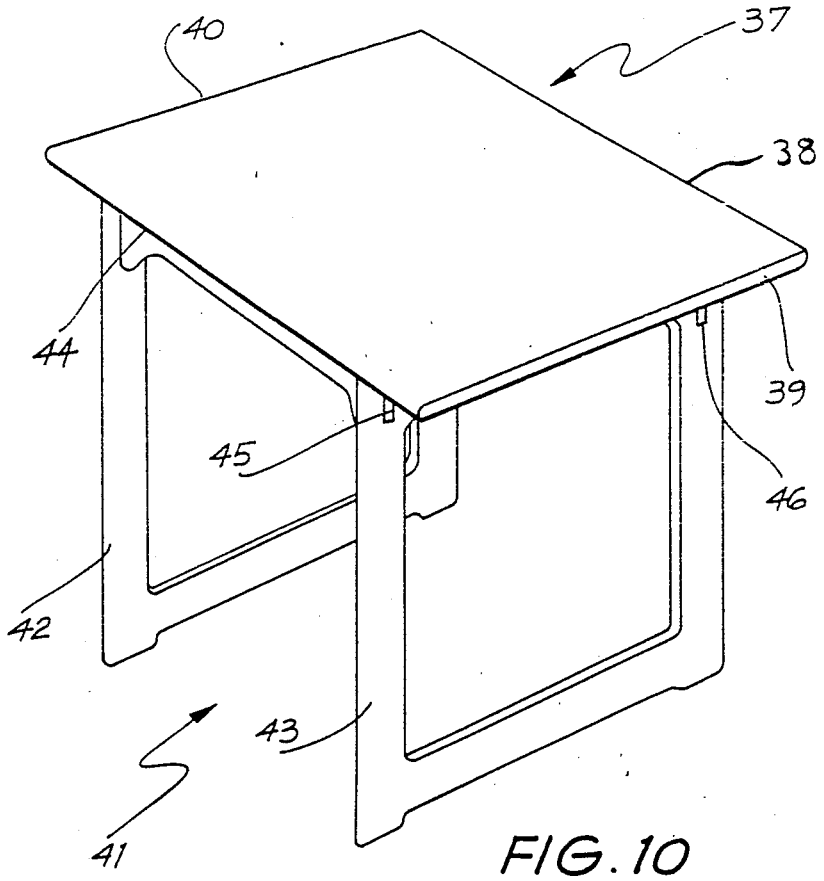
FIG. 10 is a perspective view of an additional first table top portion and leg member of the table of the present invention.

FIG. 10 shows an additional element of the table of the present invention. The element 37 comprises an alternative first table top portion 38 in the shape of a rectangle. The table top portion 38 has opposite sides 39, 40 which are the same length as the radial sides of the quadrant shaped first portion 18.

The rectangular table top portion 38 is supported by self-supporting leg member 41 comprising support arms 42, 43 interconnected by two bracing members (one not shown) 44. The bracing members 44 are releasably secured to the support arms by a similar arrangement as the rail members 20, 21 interconnect two leg members. The bracing members 44 are releasably secured between the support arms by way of a dovetailed tenon located at either end of the bracing members and their corresponding recesses located on the support arms 42, 43.

Recesses 45 and 46 are also located on support arms 42 and 43 thereby enabling the leg member 41 to be connected by way of rail members 20, 21 to any of the leg members 11, 12, 13, 14 which support the quadrant shaped first table top portions or to another leg member 41 which supports the rectangular shaped table top portion. Therefore, any of the leg members 11, 12, 13, 14 or 41 can be interconnected by the rail members 20 and 21.

In use, this additional element 37 is incorporated in the table arrangement to further add flexibility to the present invention as it can be incorporated into the existing standard table arrangement to extend the length or width of the table. This occurs because the table top 38 is rectangular and by having the leg members self-supporting, any number of leg members 41 can be interconnected by the rail members 20, 21 in any one direction.

The rectangular table top portion 38 is connected to the leg member 41 by the same type of interfitting projections and recesses as shown in FIGS. 8, 9A and 9B.

Variations and modifications may be made in respect of the invention as above described and defined in the following claims.

What we claim is:

1. A table comprising at least one pair of leg members, each leg member being self-supporting, a respective bearer interconnecting the leg members of each pair, a multi-portion table top carried by the leg members and the bearer, the table top having first and second portions which abut to form a continuous surface, the first portion being removably mounted to a respective one of the leg members of the pair and the second portion being removably mounted to the respective bearer for the leg members of the pair, the table top portions and the leg members and the bearer being formed with interfitting projections and recesses which are connected to position and locate the first table top portions onto the respective leg members and the second table top portions onto the bearer and to facilitate disconnection of the projections and recesses from each other and enable rearrangement of the table top portions in a desired configuration.

2. A table as claimed in claim 1, wherein each of the first table top portions is substantially in the shape of a quadrant

3. A table as claimed in claim 2, wherein each of the second table top portions is rectangular having at least two opposite sides the same length as the radial sides of the quadrant shaped first portion.

4. A table as claimed in claim 2, wherein a circular recess is located at the intersecting edge of the radial sides of the quadrant thereby reducing the length of the radial sides of the quadrant.

5. A table as claimed in claim 2, wherein the leg members of the quadrant shaped portions comprise first and second support arms intersecting along a vertical line, the first and second support arms being hinged along the intersecting vertical line thereby enabling the first support arm to be positioned parallel and adjacent the second support arm in a collapsed arrangement and also enabling the first support arm to be oriented at substantially 90° to the second support arm in an operational position, and a bracing member releasably secured between the first and second support arms when in the operational position to rigidly secure the support arms in position.

6. A table as claimed in claim 5, wherein the bracing member is releasably secured to the first and second support arms by a dovetail tenon located at either end of the bracing member and a corresponding recess on the first and second support arms.

7. A table as claimed in claim 1, wherein each bearer comprises two rail members.

8. A table as claimed in claim 7, wherein the interfitting projections and recesses enabling the two rail members to interconnect two leg members comprise a dovetailed tenon located at either end of each rail member and there being corresponding recesses located on the leg members, the recesses being located on the leg members such that when the rail members are in position interconnecting the leg members, the rail members are substantially parallel to one another.

9. A table as claimed in claim 1, wherein at least one of the first table top portions is substantially in the shape of a quadrant, and wherein at least one additional first table top portion is provided having the shape of a rectangle having at least two opposite sides the same length as the radial sides of the quadrant shaped first portions.

10. A table as claimed in claim 9, wherein the leg members for the rectangular shaped first portions comprise two substantially parallel support arms interconnected by two bracing members.

11. A table as claimed in claim 10, wherein the bracing members are releasably secured between the support arms by way of a dovetailed tenon located at either end of each bracing member and there being corresponding recesses located on the support arms.

* * * * *